United States Patent [19]

Winter

[11] Patent Number: 4,780,904

[45] Date of Patent: Oct. 25, 1988

[54] FOCUSSABLE ANTI-SCATTER GRID

[76] Inventor: Richard Winter, c/o XRE Corporation, 300 Foster St., Littleton, Mass. 01460

[21] Appl. No.: 97,652

[22] Filed: Sep. 16, 1987

[51] Int. Cl.[4] ..... G21K 1/00

[52] U.S. Cl. ..... 378/154; 378/153; 378/150

[58] Field of Search ..... 378/7, 145, 147, 150, 378/153, 154

[56] References Cited

U.S. PATENT DOCUMENTS

| | | | |
|---|---|---|---|
| Re. 29,894 | 1/1979 | Hounsfield | 378/7 |
| 2,659,017 | 11/1953 | Bartow | 378/149 |
| 2,696,634 | 12/1954 | Kizaur | 378/154 |
| 3,543,024 | 11/1970 | Kantor | 378/145 |
| 3,790,782 | 2/1974 | Inoue et al. | 378/150 |
| 3,997,794 | 12/1976 | York et al. | 378/149 |
| 4,229,651 | 10/1980 | Danos | 378/147 |

FOREIGN PATENT DOCUMENTS

| | | | |
|---|---|---|---|
| 1200743 | 7/1970 | United Kingdom | 378/150 |
| 1493267 | 11/1977 | United Kingdom | 378/147 |

*Primary Examiner*—Carolyn E. Fields
*Assistant Examiner*—John C. Freeman
*Attorney, Agent, or Firm*—M. Lawrence Oliverio

[57] ABSTRACT

A focussable anti-scatter grid system comprising a plurality of X-ray photon absorptive strips mounted in spaced serial array to front and rear support plate mechanisms; the front and rear support plate mechanisms being slidably mounted to each other from front to back and fixedly mounted to each other from side to side; the rear ends of the strips being rotatably mounted to the rear support mechanism in fixedly spaced rear mounting slots; the front ends of the strips being slidably mounted to the front support plate mechanism in variably spaced front mounting slots, each front mounting slot focussing the longitudinal axis of a correspondingly mounted strip at a common focus, the focal length of the focus varying with the displacements of the front ends of the strips within the front mounting slots; a master guide slot mounted in one of the front or rear plate mechanisms and a bearing connected to the other of the front or rear plate mechanisms, the bearing being slidably engaged within the master guide slot for slidable movement therethrough; the master guide slot having a predetermined front to back and side to side profile; a drive mechanism connected to one of the master guide slot or the bearing for sliding the bearing through the length of the side to side profile of the master guide slot; wherein the front and rear plates are slid front to back relative to each other according to the front to back profile of the master guide slot as the bearing slides through the side to side profile of the master guide slot.

10 Claims, 3 Drawing Sheets

FOCUSSABLE ANTI-SCATTER GRID

BACKGROUND OF THE INVENTION

In a typical X-ray photon radiation examination, a source projecting X-ray radiation is focussed at a subject to be examined and the radiation is either absorbed by the subject or travels through the subject. Some of the radiation which passes through the subject travels unimpeded directly along the path at which it was emitted from the source while some of the radiation which passes through the subject is scattered by the subject at an angle and along a path which is different from the path at which the radiation was travelling upon its original projection from the source. The object in a typical X-ray irradiation examination cycle is to detect and record as much of the unscattered radiation which passes through the subject as possible thereby providing as true a shadow image of the subject as possible. It is therefore desirable to filter out as much of the scattered radiation as possible before it reaches the X-ray photon sensitive detector because the detection of such scattered radiation will distort the trueness of the shadow image.

Providing a grid apparatus comprising a series of X-ray photon absorptive strips in close proximity to the X-ray photon sensitive detector screen provides a mechanism for filtering some of the radiation which is scattered by the subject. Prior grid systems, however, do not align the strips such that the strips are focussed at the X-ray photon source which results in the grid apparatus filtering (absorbing) critical unscattered radiation in addition to unwanted scattered radiation.

The present invention relates to a focussable grid apparatus, and in particular to a grid apparatus which is variably and adjustably focussable to a wide variety of focal lengths.

It is therefore an object of the invention to provide a focussed and a variably focussable X-ray photon absorptive grid apparatus.

SUMMARY OF THE INVENTION

In accordance with the invention there is provided in an X-ray photon projection apparatus, a focussable anti-scatter grid system comprising a plurality of X-ray photon absorptive strips mounted in spaced serial array to front and rear support plate mechanisms; the front and rear support plate mechanisms being mounted to each other for slidable movement relative to each other from front to back and fixedly mounted to each other from side to side; the rear ends of the strips being rotatably mounted to one of the front or rear support plate mechanisms in fixedly spaced mounting holes or slots; the front ends of the strips being slidably mounted to the other of the front or rear support plate mechanisms in variably spaced mounting slots, each variably spaced mounting slot focussing the longitudinal axis of a correspondingly mounted strip at a common focus, the focal length of the focus varying with the displacements of the front ends of the strip within the variably spaced mounting slots; a master guide slot mounted in, on or to one of the front or rear plate mechanisms and a bearing connected to the other of the front or rear plate mechanisms, the bearing being slidably engaged within the master guide slot for slidable movement therethrough; the master guide slot having a predetermined front to back and side to side profile; a drive mechanism connected to one of the master guide slot or the bearing for slidably driving the bearing through the length of the side to side profile of the master guide slot; wherein the front and rear plate mechanisms are slid along a front to back displacement and rate of movement relative to each other according to the front to back profile of the master guide slot as the bearing slides through the side to side profile of the master guide slot.

The bearing may be connected to and driven by the drive mechanism with the bearing being slidably and drivably mounted to one of the plates for slidable movement of the bearing through the master guide slot which is mounted in, on or to the other of the plates.

Alternatively, the master guide slot may be connected to and driven by the drive mechanism with the master guide slot being drivably and slidably mounted on or to one of the plates for slidable movement of the bearing therethrough, the bearing being connected to the other of the plates.

Preferably, each of the front mounting slots and the master guide slot have a profile selected to vary the focal length linearly with the side to side displacement of the bearing through the master guide slot.

The strips typically comprise an X-ray absorptive material such as tantalum, lead, uranium or alloys, mixtures and laminates of such metals.

Most preferably, the front slots have a straight profile and are angled relative to each other, and the master guide slot has a curved profile. Alternatively, the front slots may each have separately curved profiles and the master guide slot may have a straight slanted profile.

In the specific embodiment discussed hereafter, the variably spaced mounting slots are shown as being provided in the front plate mechanism, and the front plate mechanism is shown as being slidable from front to back while the rear plate is fixedly mounted from front to back relative to the sides of the apparatus. In suitable alternative embodiments of the invention, the variably spaced front mounting slots may be provided in the rear mounting plate and the fixedly spaced mounting slots may be provided in the front plates. In a further suitable alternative embodiment of the invention the rear plate may be slidably mounted from front to back and the front plate may be fixedly mounted from front to back relative to the sides of the apparatus. In a further embodiment of the invention the front and rear plates may be both slidably mounted for front to back movement. In such an alternative embodiment where both the front and rear plates are slidably mounted, the drive mechanism is preferably fixedly connected to the sides of the apparatus, at least in front to back relation to the sides.

BRIEF DESCRIPTION OF THE DRAWINGS

Other objects, features, and advantages will be apparent from the following detailed description of preferred embodiments taken in conjunction with the accompanying drawing in which.

DETAILED DESCRIPTION OF PREFERRED EMBODIMENTS

Figure 1:
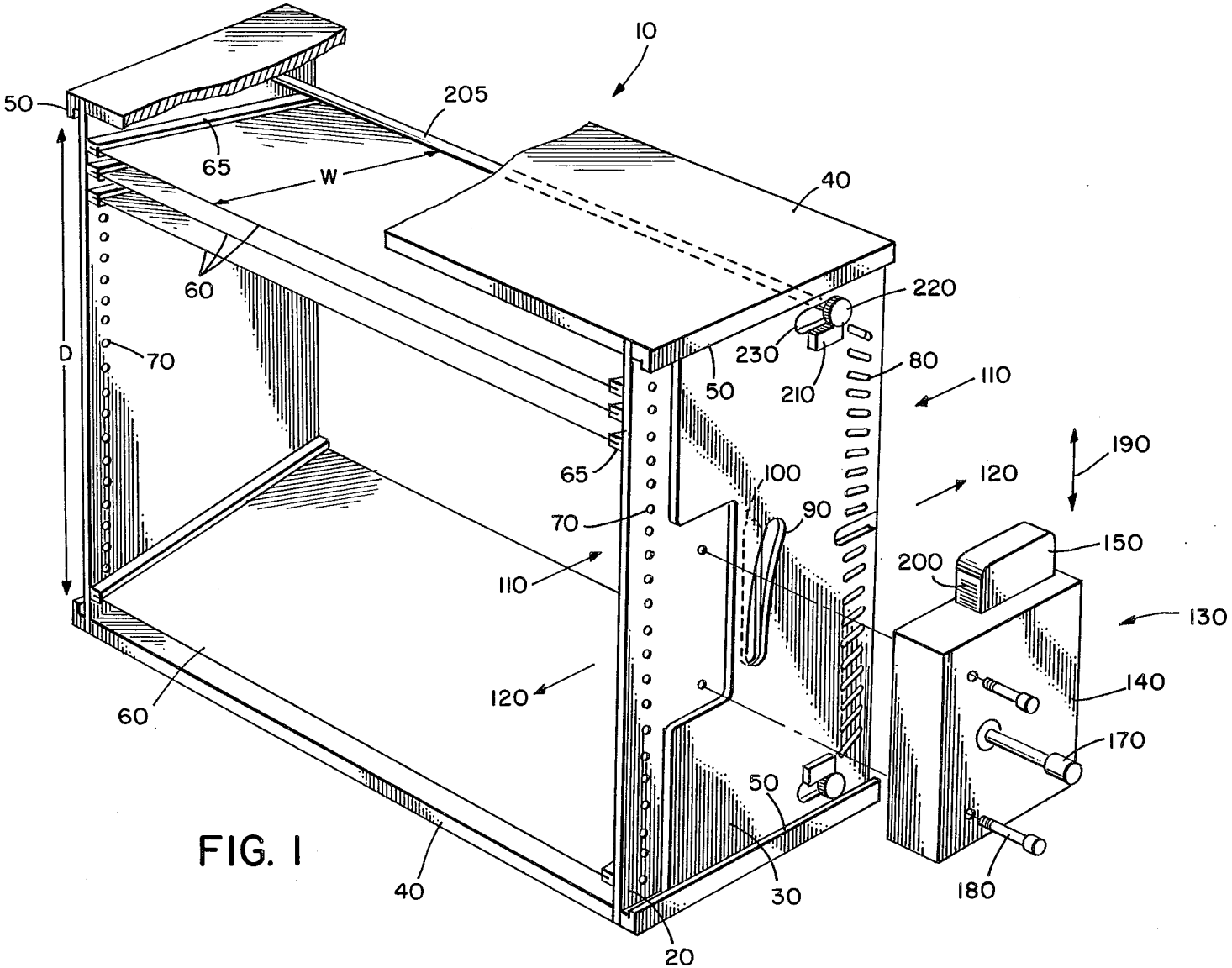
FIG. 1 is an isometric view of a focussable grid system according to the invention.

With reference to FIG. 1, there is shown a focussable anti-scatter grid system 10 comprising rear 20 and front 30 support plates fixedly mounted on their sides in face to face relationship. As shown in FIG. 1, the rear plates 20 are attached by conventional means such as bolts to side support plates 40 such that the rear plates 20 are fixedly connected to the sides support plates 40. Extending outwardly and downwardly from the side edges of rear plates 20 are flanges 50 which provide a track space having a width equal to or slightly larger than the thickness of front plates 30. The edges of the sides of plates 30 are mounted within the track spaces provided by flange sleeves 50 such that front plates 30 are slidably movable from front to back 110, 120 relative to rear plates 20.

As shown in FIG. 1, a plurality of flat X-ray photon absorptive strips 60 are mounted on their side edges in sleeves 65 which in turn are mounted at their rear ends by conventional mechanism(s) such as pins (not shown) in a series of fixedly spaced apertures 70. The apertures 70 as shown in FIG. 1 are provided on the rear plate 20 and the pins or other mounting mechanism(s) are pivotably or otherwise rotatably mounted within the apertures 70 thereby allowing the rear ends of strips 60 to pivot around the point(s) of (i.e. rotate in) the apertures 70.

Figure 2:
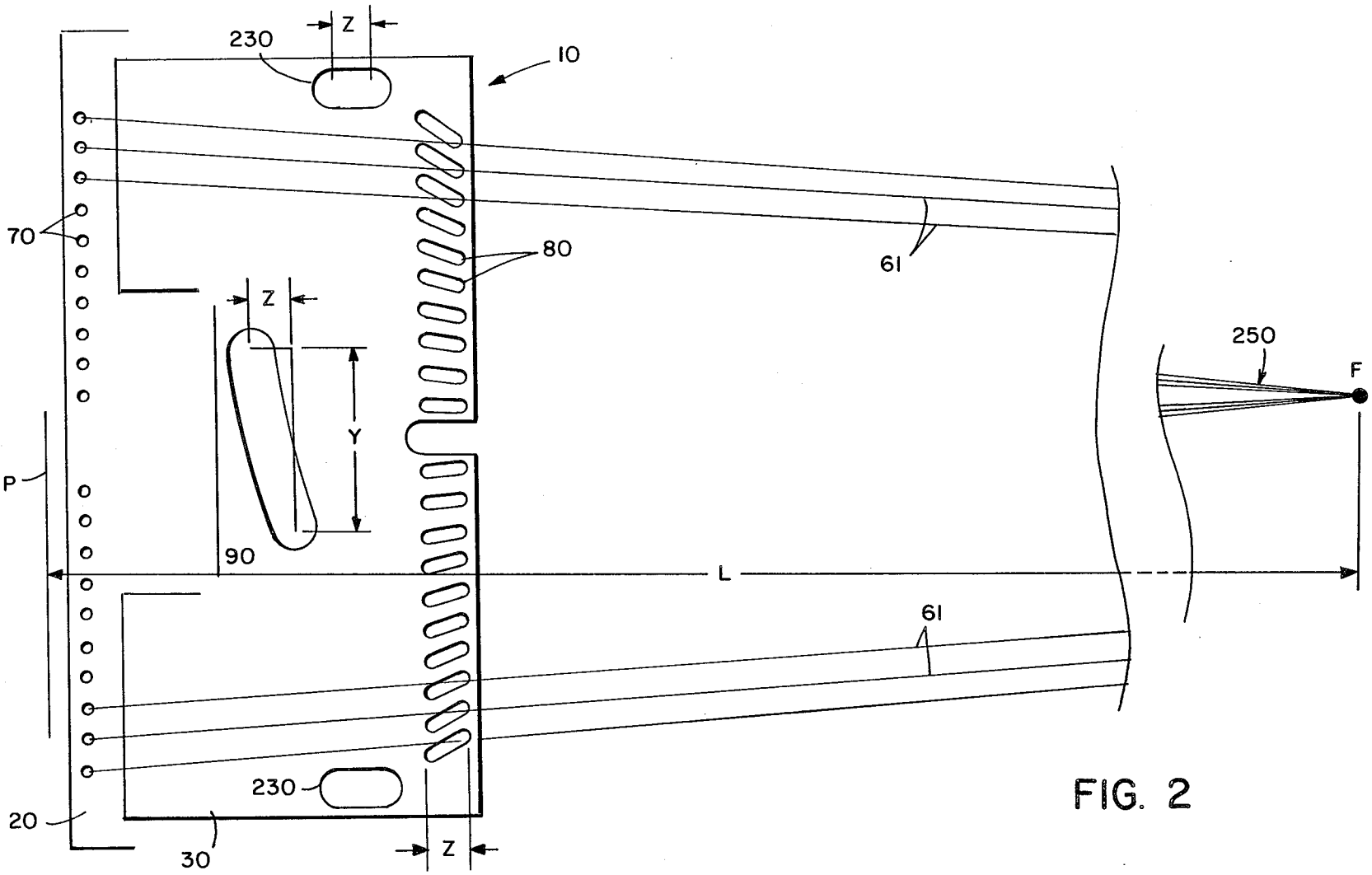
FIG. 2 is a partial side view of the focussable grid system of FIG. 1 showing a typical focal alignment.

As shown in FIGS. 1 and 2 front plate 30 includes a series of variably spaced straight slots 80 and a curved master guide slot 90. The front ends of strips 60 are slidably mounted in slots 80 in such a manner that when plates 20, 30 are slid in the direction of arrows 110 relative to each other, the front ends of the strips 60 slidably converge toward each other and when plates 20, 30 are slid in the direction of arrows 120 relative to each other the front ends of the strips diverge away from each other. In the embodiment shown in the drawings, plates 30 are slidably driven and plates 20 actually remain stationary relative to sides 40.

Figure 3:
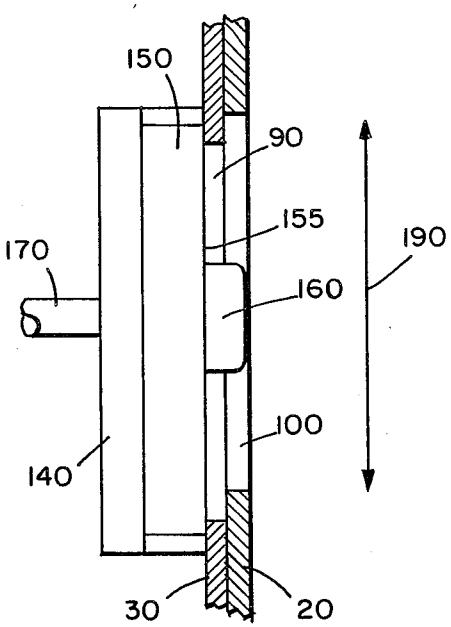
FIG. 3 is a side cross sectional view of the drive mechanism of a system according to the invention showing the engagement of the bearing within a master guide slot.
Figure 4:
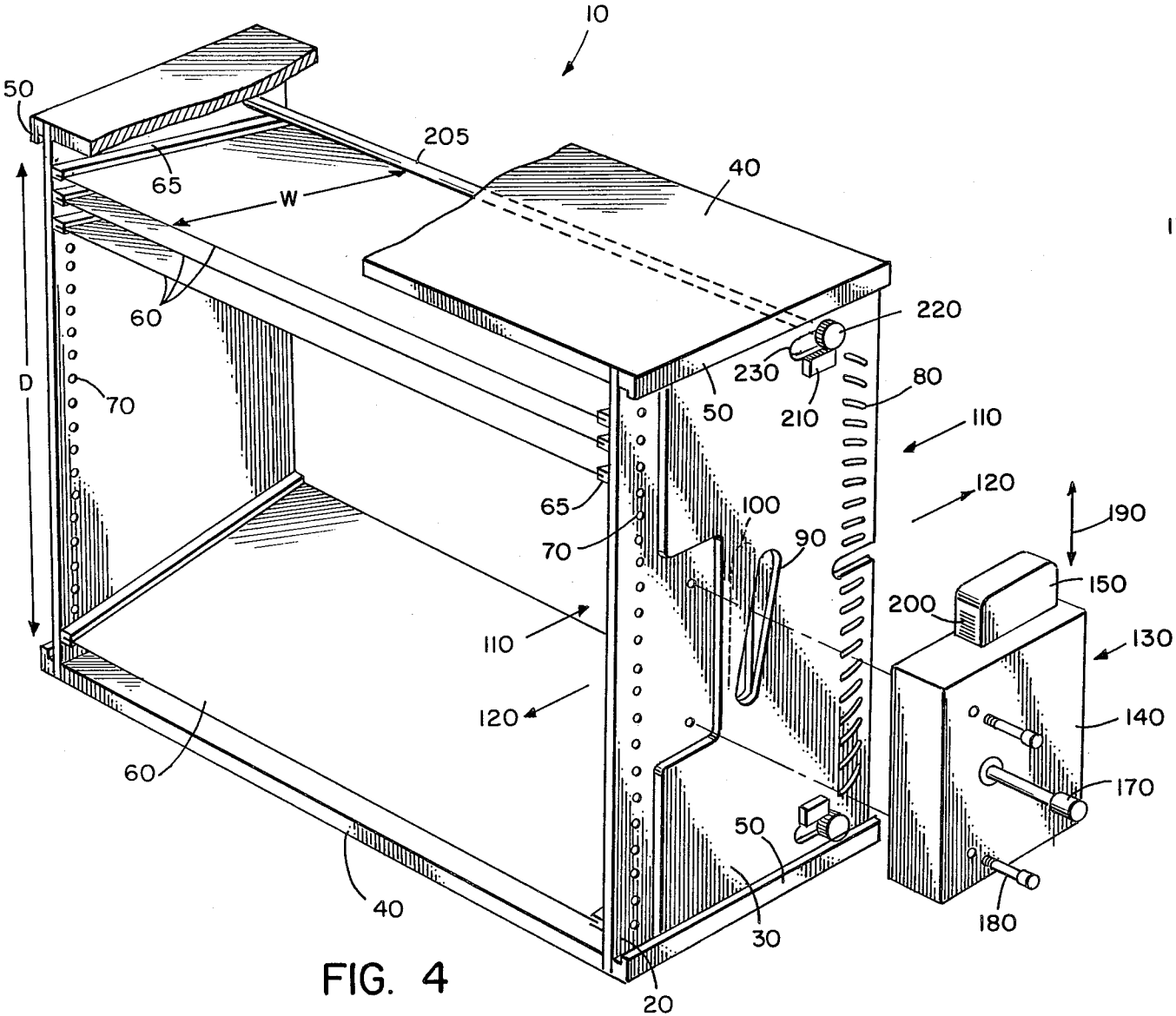
FIG. 4 is a view of a focussable grid system which has a straight master guide slot and curved profile slots.

As shown in FIG. 1 a drive control mechanism 130 is provided which includes a mounting block 140, a ball slide 150, a bearing 160 attached to the face 155, FIG. 3, of ball slide 150 and a drive shaft 170. The ball slide 150 is slidably mounted within a compatible space within block 140 in a conventional manner. Block 140 is attached to rear plate 20 by conventional means such as threaded bolts 180. As shown in cross-section in FIG. 3, when block 140 is attached to plate 20, bearing 160 protrudes from the face 155 of ball slide 150 into and through master guide slot 90 and a complementary slot 100 in plate 20, FIGS. 1, 3.

As shown in FIG. 1 complementary slot 100 is typically provided in rear plate 20 for purposes of clearance relative to the side to side 190 movement/travel of bearing 160 through slot 90 when ball slide 150 is driven from side to side, i.e. in the direction of arrows 190. Ball slide 150 is driven in the direction of arrows 190 typically by providing a drive shaft 170 with a gear wheel (not shown) which mates with an infinite gear rack 200 provided on the side of ball slide 150 as shown in FIG. 1. Drive arm 170 is typically mounted as shown in FIG. 1 in a complementary mounting aperture in block 140. Clockwise or counterclockwise rotation of drive arm 170 effects a slidable side to side 190 driving of ball slide 150 through the engagement of the gear element (not shown) which is connected to the end of arm 170 with infinite gear rack 200.

As shown in FIG. 2, slot 90 has a curved profile and has both a front to back travel profile Z and a side to side travel profile Y. As shown in FIG. 1, block 140 and ball slide 150 are mounted to plate 20 in such a manner as to allow ball slide 150 and, a fortiori, bearing 160, to travel only along a side to side travel direction 190 relative to slot 90. As a result of the fixed side edge mounting of plates 20, 30 to each other via side plates 40 and flanges 50, and the fixed mounting of block 140 to plate 20, bearing 160 may be driven only through the side to side travel profile Y and not the front to back travel profile Z of guide slot 90. When ball slide 150 and its attached bearing 160 are driven side to side 190, plate 30 is slidably driven in the tracks provided by flanges 50 front to back relative to plate 20, i.e., plates 20, 30 are driven in either the directions 110 or 120 relative to each other.

The fixed attachment of bearing 160 to plate 20 via the appropriate fixed mounting of block 140 to plate 20 allows bearing 160 to be driven solely along a side to side travel and thereby exert force on the inside edges of guide slot 90 sufficient to cause plate 30 to slide 110 or 120 through the track spaces provided by flanges 50, FIG. 1. Each of slots 80, FIGS. 1, 2 are shown as having a straight profile and the same front to back travel profile Z, FIG. 2. Each of front slots 80 however, have different side to side travel profiles, i.e., each slot 80 is slanted from side to side differently. The different slanting of each of slots 80 is provided so as to separately and always focus the longitudinal axes 61 of each of strips 60 at a common focus, F, FIG. 2.

As described hereinabove, the front ends of strips 60 are slidably mounted in the slots 80 and, as plate 30 is driven in either direction 110 or 120 relative to plate 20, the front end strip mounts, e.g. pins (not shown), slide through the slanted slots 80 causing the front ends of the strips 60 to converge or diverge. While the precise slanting of slots 80 is pre-selected to cause the longitudinal axes 61 of each of strips 60 to have a common focus, the rate and distance at and through which the front ends of the strips 60 slide through the slanted slots, and a fortiori the rate and distance at and through which the focal length L, FIG. 2, of the strips changes, will depend upon the rate and distance at and through which the plate 30 is driven in a direction 110 or 120. The rate and distance and through which the plate 30 is driven relative to plate 20 in turn depends upon the rate and distance and through which slidable block 150 and bearing 140 are driven along direction 190 and further upon the precise curvature profile of master guide slot 90, FIGS. 1 and 2.

Most preferably the curvature profile of guide slot 90 is selected so as to cause the focal length L, FIG. 2 to vary directly proportionally with the degree (or length) of side to side travel of the bearing 160 within the slot 90. This has the advantage of providing the user with a simple means of lengthening or shortening the focal length L of the axes 61 of strips 60 in a manner which is directly proportional to the side to side distance of travel of bearing 160 and/or ball slide 150, and obviates the necessity for otherwise having to determine a complex mathematical relationship of variation of the focal length, L, with the degree of side to side travel of ball slide 150 and the concomitant necessity for having to devise a complex program for controlling the rate of drive of ball slide 150 in such a manner that the focal length L can be predictably varied.

FIG. 2 shows exemplary longitudinal axes 61 of focus for strips 60 when plates 20, 30 are residing in one exemplary stationary front to back position relative to each other. If plate 30 is slid in the direction 120, FIG. 1, relative to plate 20, the focal length L, FIG. 2 will increase and, conversely, when plate 30 is slid in the direction 110 relative to plate 20, focal length L will decrease.

The length L, as shown in FIG. 2 is the so-called source to image distance, i.e. the distance L, between an X-ray photon emitter (not shown) which is positioned at F and a plane P along and coincident with which is typically located an X-ray photon sensitive screen detector. The purpose of strips 60 is to filter, i.e. absorb, radiation (photons) which are scattered by a subject when placed between the photon emitter which is located at point (or line) F and the apparatus 10, FIGS. 1, 2. The composition of the strips which filters the radiation comprises a material selected from the group of tantalum, lead, uranium and alloys, mixtures and laminates of at least one of the foregoing metals. By separately focussing the longitudinal axes 61 of each of strips 60 directly at the focal point or focal line F at which the photon emitter is located, the strips 60 will not filter (absorb) radiation which travels directly through a subject without being scattered (except for a relatively small amount of unscattered photon radiation which impinges directly on the front faces of the relatively thin strips 60 by virtue of the inherent thickness of the strips 60).

Prior anti-scatter grid devices are either not variably focussable or are not focussed at all, i.e. are arranged in substantially parallel alignment thereby causing absorption of non-scattered radiation or constructed having a "fixed" focal length L thus requiring movement of the entire grid apparatus when the source to image distance is or may be changed. As is known in the art, the detection of as much non-scattered radiation as possible is desirable in order to obtain the truest shadow image of an irradiated subject as possible. By focussing the axes 61 of each separate strip 60, FIGS. 1, 2 at the photon emitter which is located at F, the amount of non-scattered radiation (emitted from the photon source and passing through an intermediately located subject being examined) which may pass between the strips 60 through to detector plane P is maximized.

In a typical photon irradiation (X-ray) examination cycle, the distance L, FIG. 2, between the detector plane P and the location F of the photon source (the source to image distance) is predetermined. As between two different examination cycles, the sourc to image distance typically has to be changed in order to more effectively align the X-ray source to project a beam at and through a given area/volume of the subject to be examined. Inasmuch as the grid apparatus is typically mounted a fixed distance relative to the detector plane P, if, as between two different examination cycles, the source to image distance is changed or varied, the source may well be moved to a point which does not coincide with the focal length of the fixed focus grid resulting in a substantial degradation of the image which is recorded. In order to overcome such a problem, the fixed focus grid would otherwise have to be moved either closer to or further away from the detector plane P, a result which is highly undesirable because it would require cumbersome mechanisms for physically moving the grid relative to the detector plane P or which may be impossible insofar as the grid can only be moved so close to the detector plane P and/or the subject being examined.

With the variably focussable grid apparatus 10 of the present invention, the problem of having to physically move the apparatus 10 from its original position relative to plane P in order to accomodate a change in the source to image distance is obviated. In typical use, the grid apparatus 10 is mounted or attached at a position relatively closely adjacent to the plane P at which the detector screen is located as shown in FIG. 2. The detector screen typically comprises an image intensifier device and, typically, the grid apparatus 10 is fixed at a permanent position in front thereof. The subject to be examined is positioned at an appropriate location in front of apparatus 10 and the photon emitting source is positioned so as to project a beam 250 at a certain limited area/volume of the subject to be examined and simultaneously at the plane P at which the detector screen is located. The position at which the photon emitter is placed thus defines the focal point or line F and the source to image distance L. The axes 61 of the strips 60, FIGS. 1, 2 are then focussed via drive shaft 170 at point or line F. Upon the execution of a subsequent irradiation cycle, if the photon emitter source must be moved from its original position relative to plane P, or if the distance L between plane P and the position F of photon emitter source must otherwise be changed, then the apparatus 10 may be left in its original position relative to plane P and variably focussed to align axes 61 to intersect at F by simple manipulation of drive shaft 170 to account for the necessary change in L in such a subsequent irradiation cycle. In the most preferred embodiment of the invention where the curvature profile of slot 90 is predetermined so as to vary the focal length directly proportionally with the side to side travel of ball slide 150, the apparatus 10 may be very simply pre-calibrated according to a simple linear equation.

The range of distances L over which the apparatus 10 is capable of focussing is predetermined by the profiles and the degree of side to side Y and front to back travel Z selected and provided for in the profiles of slots 80, 90.

As shown in FIGS. 1, 2 the master guide slot 90 has a predetermined "curved" profile and the front slots 80 have a predetermined "straight" profile. In an alternative embodiment, the master guide slot 90 may have a predetermined straight profile and the front slots may concomitantly have predetermined curved profiles preselected so as to allow the focal length to vary directly proportionally with the degree of side to side travel of ball slide 150. Whether the master guide slot 90 or the front slots 80 are selected to be curved or straight, in the most preferred embodiment of the invention, all such master guide slot 90 and front slot 80 profiles are predetermined such that the focal length of the axes 61 of the strips 60 will vary linearly with the degree of movement/travel 190 of ball slide 150. In such a preferred embodiment, the degree of travel/movement 190 of ball slide mechanism 150 (or bearing 160) can be more easily calibrated to effect a given change axial 61 focal length which varies linearly with the degree of travel/movement 190 of the ball slide 150 (or bearing 160).

In a less preferred embodiment, both of the master guide slot and the front slots could be predetermined to both have straight or both have curved profiles whereby the focal length of axes 61 does not vary linearly with the degree of travel/movement of ball slide 150 (or bearing 90). Such an embodiment is less preferred because, in normal operation, a programmable drive mechanism for driving shaft 170 would typically be required in order to predictably and controllably vary the focal length L, FIGS. 1, 2; or a more complex calibration of the degree of change of focal length L versus the degree of movement/travel 190 of ball slide 150 would have to be determined.

In all embodiments of the invention, drive shaft 170 may be connected in a conventional manner to a drive motor mechanism which in turn may be programmed by conventional means to drive shaft 170 at predetermined rates and/or degrees.

Most preferably the apparatus 10, FIG. 1, is provided with connecting drive shafts 205 (top shaft shown, bottom shaft not shown) for simultaneous front to back driving of the opposing pair of plates 30 (left and right) as shown in FIG. 1. The connecting drive shafts 205 typically include gear wheels 220 on both ends thereof which mate with infinite gear rack elements 210 which are fixedly mounted on the outside of opposing plate(s) 30 as shown in FIG. 1.

The gear wheel 220 and infinite gear rack 210 elements which are provided on opposing ends of shafts 205 and on the outside of opposing plates 30 allow both opposing plates 30 to be driven simultaneously at the same rates and through the same front to back travel distances relative to opposing plates 20. The drive shafts 205, gears 220, and gear racks 210 also allow the use of a single drive control mechanism 130 on one side of the apparatus 10 as opposed to requiring the use of two separate drive control mechanisms on both opposing sides thereby obviating the necessity for maintaining absolute synchronization of the rate and distance of drive of two such separate drive mechanisms. As shown in FIG. 2, front to back clearance slots 230 are provided in plate(s) 30, and complementary mounting apertures (not shown) are similarly provided in plate(s) 20 through which shafts 205 extend and in which shafts 205 are rotatably mounted. The drive shafts 205 extend through such slots 230, with the gear wheels 220 connected to the end(s) thereof on the outside faces of plate(s) 30 on both the left and right sides. By virtue of the mounting of drive shafts 205 in apertures provided in plates 20, when one plate 30 is drivably slid from front to back 110, 120, the gear racks 210 which are fixedly attached to plates 30, cause the drive shafts to rotate (by virtue of the mating of racks 210 with gear wheels 220) and thus cause an opposing plate 30 which is not separately driven by a drive mechanism 130 to be driven at the same rate and through the same front to back distance as the directly driven plate 30 is driven by mechanism 130. As shown in FIG. 2 the clearance slots 230 are preferably provided with the same front to back travel profiles Z as the front to back travel profiles of slots 80, 90, FIG. 2.

FIG. 3 shows the relative positioning of housing 140, ball slide 150, bearing 160, plates 30 and 20 and slots 90 and 100 at one side to side travel position of ball slide 150. In the embodiment shown, bearing 160 is connected to the face of ball slide 150 which is movable via the turning of shaft 170 in the direction of arrow 190. When ball slide 150 is driven from side to side 190, bearing 160 slides along the edges of slot 90 and forces plate 30 to slide either forward or backward within the tracks provided by flanges 50 along a distance determined by the profile of slot 90. Shaft 170 may be driven in any conventional manner, e.g. manually or by motor. Where the shaft is driven by a motor (not shown), the drive control for the motor may be connected to a conventional mechanism which automatically measures the source to image distance and/or any changes therein. In such a system the drive control mechanism preferably includes a program which receives the measured source to image distance information and/or changes therein and automatically controls the drive of the motor to automatically change the focal length of the apparatus 10 to focus at the axes 61 of the strips 60 at the focal point F.

In a most preferred embodiment of the invention the width W, FIG. 1, the thickness, and the number of strips 60 placed along the side to side length D of apparatus 10 is pre-selected so as to maximize the capability of apparatus 10 to filter scattered radiation and to concomitantly minimize the obstruction of non-scattered radiation on the faces of strips 60.

Conventional grid systems typically employ a strip width W of less than about 0.25 inches and a strip density of about 50–300 strips per inch. By virtue of the variably focussable nature of the present apparatus 10, the present invention serves to obviate the necessity for such a cumbersome apparatus. In a preferred embodiment of the present invention the width W of the strips 60, FIGS. 1, 2 is selected to be in the range of 0.25 to about 5 inches, thereby enhancing the ability of the apparatus to filter scattered radiation. Most preferably the width W of the strips 60 is selected to be between about 0.75 and about 4 inches. The density of the strips 60, i.e. the number of strips 60 mounted in the apparatus 10 along the side to side length D of the apparatus 10 is preferably selected to be less than about 10 strips per inch and, most preferably between about 1 and about 5 strips per inch thereby substantially reducing the complexity of the apparatus 10 and the obstruction of non-scattered radiation on the face of the strips 60. And, the thickness of the strips 60 is typically selected to be less than about 10 mils (thousands of an inch). The combination of employing a strip width W of between about 0.25 and 5 inches, a strip density of less than about 10 strips per inch, and a strip 60 thickness of less than about 10 mils, results in a grid apparatus 10 which is capable of filtering (absorbing) the vast majority of the scattered radiation and obstructing (by impingement on the front edges of strips 60) less than about fourteen, and more typically less than about five (5) percent, of the non-scattered radiation which is projected from the source located at F and which penetrates the subject to be examined. For example in a system where the strip density is about 2.5 strips per inch and the strips have a thickness of about 0.004 inches and a height of about 3 inches, less than about 2% of non-scattered radiation will be obstructed.

As described in the preferred embodiments of the invention hereinabove, the master guide slot 90, FIGS. 1, 2, is shown as being provided in plate 30 and the bearing 160 is shown as being attached to ball slide 150. In an alternative embodiment the master guide slot may be incorporated into (onto) the face of ball slide 150 (or the face of ball slide 150 may otherwise have a plate or other device attached thereto which incorporates the master guide slot). And, the bearing 160 may concomitantly be fixedly attached to plate 30. In such an alternative embodiment bearing 160 and master guide slot are simply juxtaposed but effect the same rate and distance of front to back travel of plate 30 relative to plate 20 as described hereinabove with respect to the specific embodiment shown in the drawings.

In alternative embodiments of the invention the variably spaced slots 80 may be provided in plate 20 and the fixedly spaced apertures may be provided in plate 30. In further alternative embodiments plates 30 may be fixedly connected to side plates 40 and plates 20 may be slidably mounted within tracks and driven in the same manner as described above with reference to plate 30; or both of plates 20 and 30 may be slidably mounted within tracks and the drive mechanism fixedly connected to the side plates 40. In all such alternative embodiments, the slant and/or curvature profiles of slots 80 and the master guide slot 90 are most preferably pre-selected so as to allow the focal length to vary linearly with the side to side travel of ball slide 150.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. In an X-ray photon projection apparatus, a focussable anti-scatter grid system comprising:

a plurality of X-ray photon absorptive strips mounted in spaced serial array to front and rear support plate means and wherein each of said X-ray photon absorptive strips comprises a front end and a rear end;

front and rear support plate means being mounted to each other for slidable movement from front to back and fixedly mounted to each other from side to side;

one of the front or the rear ends of the strips being rotatably mounted to one of the front or the rear support plate means in fixedly spaced mounting slots;

the other of the front or the rear ends of the strips being slidably mounted to the other of the front or the rear support plate means in variably spaced mounting slots, each variably spaced mounting slot focussing the longitudinal axis of a correspondingly mounted strip at a common focus, the focal length of the focus varying with the displacements of the ends of the strips within the variably spaced mounting slots;

a master guide slot mounted in or on one of the front or rear plate means and a bearing connected to the other of the front or rear plate means, the bearing being slidably engaged within the master guide slot for slidable movement therethrough;

the master guide slot having a predetermined front to back and side to side profile;

a drive means connected to one of the master guide slot or the bearing for sliding the bearing through the length of the side to side profile of the master guide slot;

wherein the front and rear plates are slid front to back relative to each other according to the front to back profile of the master guide slot as the bearing slides through the side to side profile of the master guide slot.

2. The apparatus of claim 1 wherein the bearing is connected to and driven by the drive means, the bearing being movably connected to one of the plates for slidable movement through the master guide slot which is provided on the other of the plates.

3. The apparatus of claim 1 wherein the master guide slot is connected to and driven by the drive means, the master guide slot being movably mounted on one of the plates for slidable movement of the bearing therethrough, the bearing being connected to the other of the plates.

4. The apparatus of claim 1 wherein each of the variably spaced mounting slots and the master guide slot have a profile selected to vary the focal length of the apparatus linearly with the side to side displacement of the bearing through the master guide slot.

5. The apparatus of claim 4 wherein the strips comprise an X-ray absorptive material selected from the group of tantalum, lead, uranium and alloys, mixtures and laminates of at least one of the foregoing metals.

6. The apparatus of claim 4 wherein the variably spaced slots each have a straight profile and are angled relative to each other and wherein the master guide slot has a curved profile.

7. The apparatus of claim 4 wherein the variably spaced slots each have a separately curved profile and the master guide slot has a straight profile.

8. In an X-ray photon projection apparatus, a focussable anti-scatter grid system comprising:

a plurality of X-ray photon absorptive strips mounted in spaced serial array to front and rear support plate means;

the front and rear support plate means being mounted to each other for slidable movement from front to back and fixedly mounted to each other from side to side;

the rear ends of the strips being rotatably mounted to the rear support means in fixedly spaced rear mounting slots;

the front ends of the strips being slidably mounted to the front support plate means in variably spaced front mounting slots, each front mounting slot focussing the longitudinal axis of a correspondingly mounted strip at a common focus, the focal length of the focus varying with the displacements of the front ends of the strips within the front mounting slots;

a master guide slot mounted in one of the front or rear plate means and a bearing connected to the other of the front or rear plate means, the bearing being slidably engaged within the master guide slot for slidable movement therethrough;

the master guide slot having a predetermined front to back and side to side profile;

a drive means connected to one of the master guide slot or the bearing for sliding the bearing through the length of the side to side profile of the master guide slot;

9. In an X-ray photon projection apparatus having an X-ray photon source, a focussable anti-scatter grid system comprising:

a plurality of serially spaced X-ray photon absorptive strips;

means for rotatably mounting one of the front or the rear end of each of the strips at fixedly spaced intervals;

means for mounting the other of the front or the rear end of each of the strips in a manner such that each strip may be independently rotated about its rotatable mount to vary the spacing between the strips and to focus the longitudinal axis of each strip at a common focal point; and means for simultaneously rotating all of the strips about their respective rotatable mounts to focus the longitudinal axes of all of the strips at the X-ray photon source.

10. In an X-ray photon projection apparatus having an X-ray photon source, a method of filtering out scattered radiation comprising the steps of:

mounting one of the front or the rear ends of a plurality of serially spaced X-ray photon absorptive strips in a series of fixedly spaced rotatable mounting means such that the one of the front or the rear end of each strip may be independently rotated about its rotatably mounted end to focus the longitudinal axis of each of the strips at a common focal point; and simultaneously rotating all of the strips about their respective rotatably mounted ends to focus the longitudinal axis of all of the strips at the common focal point at which the X-ray photon source is positioned.

* * * * *